US006070995A

United States Patent [19]

Kanai

[11] Patent Number: 6,070,995

[45] Date of Patent: Jun. 6, 2000

[54] RECESSED OVERHEAD LIGHTING DEVICE

[76] Inventor: Shoichi Kanai, 17 Nakazaike-cho, Nagitsuji, Yamashina-ku, Kyoto-shi, kyoto 607, Japan

[21] Appl. No.: 08/925,123

[22] Filed: Sep. 8, 1997

[30] Foreign Application Priority Data

Sep. 10, 1996 [JP] Japan ..... 8-262444
May 26, 1997 [JP] Japan ..... 9-134592

[51] Int. Cl.[7] ..... F21V 15/00; F21S 4/00; F21S 8/00

[52] U.S. Cl. ..... 362/365; 362/364; 362/225; 362/148

[58] Field of Search ..... 362/364, 365, 362/148, 225; 248/27.1

[56] References Cited

U.S. PATENT DOCUMENTS

| | | | |
|---|---|---|---|
| 3,664,615 | 5/1972 | Kruger | 248/27.1 |
| 4,424,554 | 1/1984 | Woloski et al. | 362/365 |
| 4,600,978 | 7/1986 | Kimura | 362/365 |
| 5,475,577 | 12/1995 | Vanderhoof et al. | 362/148 |
| 5,609,414 | 3/1997 | Caluori | 362/365 |

*Primary Examiner*—Cassandra Spyrou
*Assistant Examiner*—Jennifer Winstedt
*Attorney, Agent, or Firm*—Sughrue, Mion, Zinn, Macpeak & Seas, PLLC

[57] ABSTRACT

A recessed overhead lighting device adapted to be encased in a mounting opening defined in a ceiling panel which is supported by ceiling joists. The lighting device includes a shade structure for supporting at least one tubular lamp and having a reflective surface and also having opposite side flanges. At least one pair of generally elongated mounting members, each having first and second end portions opposite to each other, are mounted on the shade structure. The mounting members are movable between release and set positions, but are held in the release position during insertion of the shade structure from below into the mounting opening. The mounting members are, however, pivoted towards the set position, when the shade structure is inserted from below into the mounting opening, to cause the first end portions of the mounting members to cooperate with the side flanges of the shade structure to sandwich the ceiling joists and the ceiling panel, to thereby complete fitting of the lighting device to the ceiling panel. A fixture is provided on each of the mounting members for locking the associated mounting member at the set position after the shade structure has been completely inserted into the mounting opening.

13 Claims, 10 Drawing Sheets

RECESSED OVERHEAD LIGHTING DEVICE

BACKGROUND OF THE INVENTION 1. (Field of the Invention)

The present invention generally relates to an electric lighting device and, more particularly, to a recessed overhead lighting device of a type adapted to be encased in a ceiling in an architecture such as a reinforced concrete building or housing.

2. (Description of the Prior Art)

The recessed overhead lighting device now available in the market is generally supported by a ceiling in a suspended fashion in the following manner. During preparation of ceiling slabs by pouring a concrete material into molds, insert screws are embedded in predetermined locations in each ceiling slab so that upon completion of a building, the insert screws can extend downwardly from the concrete slab which partitions the interior of the building into upper and lower rooms. Each of the insert screws is adapted to threadingly receive an upper end of an externally threaded headless bolt.

On the other hand, a generally grid-patterned panel support frame-work including a plurality of elongated ceiling joist supports extending parallel to each other and spaced a predetermined pitch from each other, and a plurality of elongated ceiling joists extending parallel to each other and also extending transverse to the ceiling joist supports and spaced a predetermined pitch from each other is disposed immediately beneath the ceiling slab. Ceiling panels are subsequently secured to the ceiling joists to complete the ceiling.

The prior art lighting device is mounted in a mounting opening defined in one of the ceiling panels by inserting it from below into the mounting opening. At the time the prior art lighting device is inserted from below into the mounting opening, respective lower ends of the headless bolts embedded at their upper ends in the ceiling slab are, after having been bent to align with associated bearing holes defined in the lighting device, inserted into the associated bearing holes. Internally threaded nuts are then fastened from below to the lower ends of the respective bolts so that the prior art lighting device can be suspended from the ceiling slab in a fashion inserted in the mounting opening.

The mounting of the prior art lighting device described above involves numerous problems. For example, in the event that even the single insert screw has been inadvertently omitted by, for example, the reason that during the preparation of the ceiling slabs the attendant worker has forgotten to implant it in the mold, the concrete ceiling slab must be drilled so that an anchor bolt can be inserted into the concrete ceiling slab prior to the mounting of the lighting device. This is indeed a complicated and time-consuming job which ought not to have been performed.

Another problem occurs if the insert screws are not accurately positioned in the concrete ceiling slab. Inaccurate positioning of the insert screws in the concrete ceiling slab makes it difficult to install the lighting device relative to the ceiling and, even if it can be successfully installed, the skilled worker must exercise such a complicated and time-consuming job so that the lighting device can be supported stably. In addition, installation of the prior art lighting device requires a preparatory job of marking lines on the concrete slab for positioning purpose, resulting in an increase of the cost for installation of the prior art lighting device.

Considering that the prior art recessed overhead lighting device is supported solely by means of the headless bolts in a fashion suspended from the concrete slab, it has been found that the lighting device once installed tends to be considerably displaced sidewise relative to the ceiling panel in the event of occurrence of an earthquake, to such an extent as to collide against the peripheral lip region of the ceiling panel around the mounting opening. Once this occurs, the lighting device tends to be displaced in position, skewed, damaged and/or separated from the ceiling. This problem has been reported when the disastrous Kobe Earthquake occurred recently.

SUMMARY OF THE INVENTION

Accordingly, the present invention is intended to provide an improved recessed overhead lighting device which can be easily and quickly secured to the ceiling with no sophisticated skill required.

Another important object of the present invention is to provide an improved recessed overhead lighting device of the type referred to above, which can be stably supported enough to withstand the earthquake.

In order to accomplish this and other objects of the present invention, there is provided a recessed overhead lighting device adapted to be encased in a mounting opening defined in a ceiling panel which is supported by ceiling joists. This lighting device includes a shade structure for supporting at least one tubular lamp and having a reflective surface and also having opposite side flanges. At least one pair of generally elongated mounting members, each having first and second end portions opposite to each other, are mounted on the shade structure. The mounting members are movable between release and set positions, but are held in the release position during insertion of the shade structure from below into the mounting opening. The mounting members are, however, moved towards the set position, when the shade structure is inserted from below into the mounting opening, to cause the first end portions of the mounting members to cooperate with the side flanges of the shade structure to sandwich the ceiling joists and the ceiling panel, to thereby complete fitting of the lighting device to the ceiling panel. A fixture is provided on each of the mounting members for locking the associated mounting member at the set position after the shade structure has been completely inserted into the mounting opening.

With this structure, when the lighting device of the present invention is to be installed to the ceiling, the shade structure having the mounting members held in the release position is inserted from below into the mounting opening until the side flanges of the shade structure are brought into contact with the ceiling panel. Thereafter, the mounting members are manipulated one at a time from below the shade structure to move the mounting members towards the set position so that the adjacent ceiling joists and the ceiling panel can be sandwiched between the side flanges of the shade structure and the first end portions of the respective mounting members. When the fixtures are subsequently manipulated to fix the mounting members, the mounting members are set immovably in the set position relative to the shade structure. Accordingly, the lighting device can be supported with the side flanges of the shade structure and the first end portions of the mounting members clamping the adjacent ceiling joists and the ceiling panel.

According to the present invention, since the recessed overhead lighting device is so designed and so structured as to be fitted to the ceiling with the ceiling panel and the ceiling joists sandwiched between the upturned side flanges and the mounting members of the shade structure, the necessity of use of such insert screws which have hitherto been required can advantageously be eliminated. Thus, the present invention dispenses with a complicated and time-consuming job which would be brought about when the insert screws would not be inadvertently embedded in the concrete ceiling slab. Also, since the lighting device embodying the present invention can easily be installed to the ceiling merely by an operation needed to move the mounting members from below and also an operation needed to manipulate the fixtures, not only is no skill required for the attendant worker to install the lighting device to the ceiling, but also the lighting device can easily and quickly be mounted in the mounting opening, accompanied by reduction in cost for installation of the lighting device.

Moreover, considering that the lighting device of the present invention can be connected directly to the ceiling joists and the ceiling panel, it can be stably supported without being displaced in position relative to the ceiling panel, skewed, damaged and/or separated even though an earthquake occurs.

Preferably, the second end portion of each of the mounting members defines a closure body having upper and lower surfaces opposite to each other. The lower surface of the closure body of each mounting member can be held in flush with a lower surface of the shade structure when the associated mounting member is moved to the set position, so that the aesthetic appearance of the lighting device completely secured to the ceiling will not be deteriorated.

Also preferably, each of the mounting member is pivotally mounted on the shade structure by means of a shaft member extending parallel to the longitudinal axis of the shade structure. This makes it possible to accomplish pivotal movement of each mounting members from the release position towards the set position merely by turning the respective mounting member.

The lighting device of the present invention may further comprise a spacer mounted on each of the mounting members and movable between an advanced position, at which the spacer confronts a side portion of the shade structure facing the adjacent ceiling joist, and a retracted position at which the spacer is retracted upwardly of the adjacent ceiling joist.

The use of the spacer for each of the mounting members makes it possible to accommodate a varying spacing between the neighboring ceiling joists. In other words, even though the ceiling joists are spaced a predetermined pitch from each other, the spacing between the neighboring ceiling joists may vary because of the availability of the ceiling joists of varying widths. For example, the spacing between the ceiling joists each having a relatively small width will be greater than the spacing between the ceiling joists of a relatively large width. Accordingly, by adjusting the spacer on each of the mounting members selectively to one of the advanced and retracted positions, the lighting device of the present invention can be snugly fitted in the mounting opening regardless of the width of the ceiling joists.

Simultaneously therewith or separate therefrom, the lighting device of the present invention may further comprise an attachment angularly adjustably mounted on each of the mounting members. This attachment has a plurality of side abutment faces spaced angularly from each other about a longitudinal axis of the corresponding mounting member and also spaced a progressively varying distance laterally outwardly from the longitudinal axis of the corresponding mounting member. This attachment may form the first end portion of each of the mounting members.

The attachment on each of the mounting member serve to accommodate a change in thickness of the ceiling to thereby adjust the heightwise level at which the shade structure is installed relative to the ceiling joists. More specifically, while the first end portion of each of the mounting members when the latter is pivoted to the set position rests on the adjacent ceiling joist, selection of one of the side abutment faces of the attachment makes it possible to adjust the heightwise level at which the shade structure is installed relative to the ceiling joists. In other words, by selecting one of the side abutment faces of the attachment, the spacing between the selected side abutment face of the attachment and the adjacent side flange of the shade structure, which cooperate with each other to clamp the ceiling joist and the ceiling panel, can advantageously be adjusted to accommodate a change in thickness of the ceiling panel.

Accordingly, the use of the attachments makes it possible to allow the lighting device to be satisfactorily installed to the ceiling regardless of the thickness of the ceiling panel with the ceiling panel and the ceiling joists firmly sandwiched between the selected side abutment face of each attachment and the adjacent side flange of the shade structure.

Again preferably, the shade structure may be disposed with its longitudinal axis lying parallel to the ceiling joist. In such case, two pairs of the mounting members may be employed with the mounting members of each pair positioned on one side of the shade structure with respect to the longitudinal axis thereof. Preferably, the pairs of the mounting members are spaced an asymmetric distance endwise from an imaginary line drawn so as to extend transverse to a point intermediate of the length of the shade structure.

Considering that the lighting device of the present invention is disposed with its longitudinal axis lying parallel to the ceiling joists and the ceiling joist supports extend transverse to the ceiling joists, it may occur that depending on the position of the mounting opening defined in the ceiling panel, the second end portions of the mounting members then held at the release position may collide against the ceiling joist support during the insertion of the shade structure into the mounting opening. Where this is likely to happen, the disposition of the pairs of the mounting members in an asymmetrical fashion with respect to the imaginary line extending transverse to the intermediate point of the length of the shade structure is effective to permit the lighting device to be received within the mounting opening, provided that the lighting device is reversed endwise.

At least one pair of insertion guide pieces may preferably be fixedly mounted on the shade structure. In such case, the insertion guide pieces of the pair have to be spaced a distance slightly smaller than a width of the mounting opening in a direction widthwise of the shade structure. The use of the insertion guide pieces allows the shade structure to be smoothly inserted into the mounting opening as the insertion guide pieces serves to guide the shade structure in sliding contact with the cut side edges defining the mounting opening in the ceiling panel. The use of the pairs of the insertion guide pieces does not only bring about an increase in workability, but also avoid a possible damage to the ceiling which would occur when during the insertion of the shade structure into the mounting opening the shade structure is unnecessarily be shaken laterally.

To facilitate centering of the shade structure relative to the mounting opening, the lighting device of the present invention may preferably comprise at least one pair of centering members. Where the pair of the centering members are employed, they are to be pivotally mounted on the shade structure and spaced in a direction widthwise of the shade structure. Each of the centering member includes an engagement arm, which is, during insertion of the shade structure from below into the mounting opening, pushed downwardly in contact with the ceiling panel to cause the corresponding centering member to pivot, and a side abutment arm which is held in contact with a side face of the adjacent ceiling joist in response to the pivot of the corresponding centering member.

The use of the centering members is advantageous in that the shade structure can automatically be centered relative to the mounting opening with the centering members held in contact with associated side faces of the adjacent ceiling joists, rendering the job of installation to be simple and easy to accomplish with no skill needed.

Each of the centering members may be connected with a connecting member for angularly moving the respective centering member in operative association with angular movement of the corresponding mounting member. In such case, each of the centering members can be pivoted in response to contact of the engagement arm with the ceiling panel during insertion of the shade structure into the mounting opening, but prior to the side flanges brought into contact with the ceiling panel, to thereby cause the respective mounting member to be pivoted from the release position towards the set position.

According to the use of the centering members connected with the respective mounting members through the associated connecting members, mere insertion of the shade structure into the mounting opening is sufficient not only to allow the shade structure to be automatically centered relative to the mounting opening, but also to cause the mounting members to be automatically moved to the set position in which the ceiling panel and the ceiling joists are sandwiched between the attachments and the side flanges. For this reason, the lighting device of the present invention can quickly, but accurately be installed at the ceiling with no difficulty.

Where the elastic abutment piece is provided on the side abutment arms of the respective centering members, when at the time the side flanges of the shade structure are brought into contact with the ceiling panel, the side contact arms of the respective centering members then pivoting are brought into contact with the adjacent side faces of the neighboring ceiling joists, the associated elastic abutment pieces are elastically deformed in contact with the adjacent side faces of the neighboring ceiling joists, wherefor the shade structure can be automatically centered relative to the mounting opening by the action of not only the opposite side contact arms of the pairs of the centering members, but also the associated abutment pieces. Thus, the shade structure can easily and quickly positioned at a centered position in and relative to the mounting opening regardless of the spacing between the ceiling joists.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS (First Preferred Embodiment)

Figure 1:
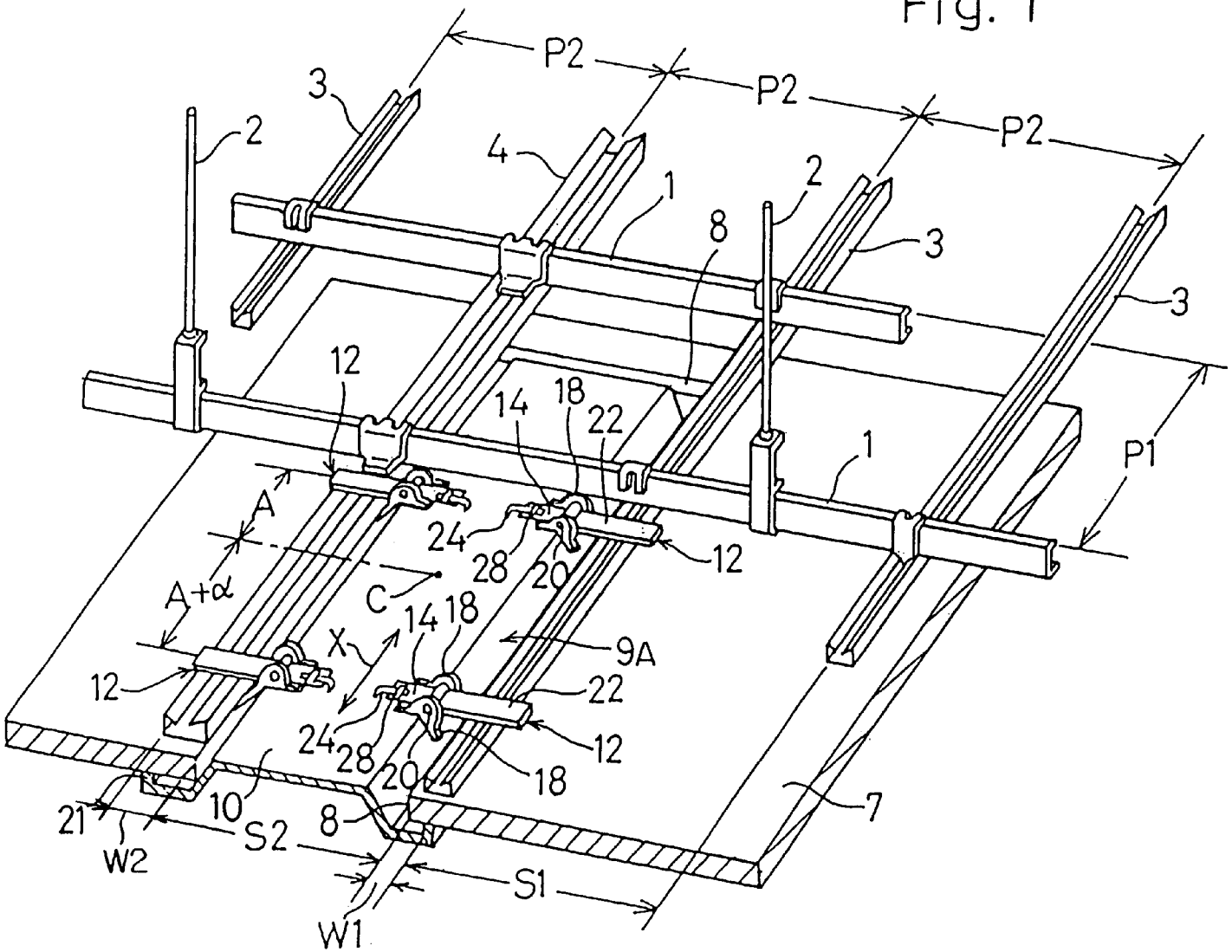
FIG. 1 is a fragmentary perspective view of a recessed overhead lighting device according to a first preferred embodiment of the present invention as viewed from behind the ceiling, showing the manner in which the recessed overhead lighting device is embedded in the ceiling.

FIG. 1 is a fragmentary perspective view of a recessed overhead lighting device according to a first preferred embodiment of the present invention as viewed from behind the ceiling, showing the manner in which the recessed overhead lighting device is embedded in the ceiling. As shown therein, a plurality of elongated ceiling joist supports 1, each in the form of a light-weight steel bar, are supported connected to a concrete ceiling slab (not shown) by a plurality of anchor bolts 2 so as to extend parallel to each other and also as to lie generally parallel to the concrete ceiling slab. The ceiling joist supports 1 so supported are positioned a distance beneath the ceiling and are spaced from each other a predetermined pitch P1 which may generally be specified in the related regulations. A plurality of elongated ceiling joists 3 and 4, which are in the form of lightweight steel bars, are connected from below to the ceiling joist supports 1 so as to extend transverse to the ceiling joist supports 1 while they are spaced from each other a predetermined pitch P2 which may generally be specified in the related regulations. The ceiling joist supports 1 and the ceiling joists 3 and 4 connected to the ceiling joist supports 1 are so laid as to form a generally grid-patterned panel support framework for the support of a plurality of generally oblong ceiling panels 7 that are secured from below to the ceiling joists 3 and 4 with the longitudinal axis thereof extending substantially parallel to the ceiling joists 3 and 4, to thereby complete a ceiling.

The ceiling joists are employed in two types: The ceiling joists 3 have a width W1 and are used to support the individual ceiling panels 7 secured thereto, and the ceiling joists 4 have a width W2 which may be double of the width W1 and are used to support butt joint regions of the neighboring ceiling panels 7 while straddling between the neighboring ceiling panels 7.

Even though the ceiling joists 3 and 4 have the respective widths different from each other, each group of the ceiling joists 3 and 4 are spaced the same pitch P2 from each other as described above. Therefore, the distance of separation S1 as defined between one of opposite sides of one reduced-width ceiling joist 3 and one of opposite sides of the neighboring reduced-width ceiling joist 3 which confronts such one of the opposite sides of such one reduced-width ceiling joist 3 is smaller by (W2−W1)/2 than the distance of separation S2 as defined between one of opposite sides of one of the reduced-width ceiling joists 3 and one of opposite sides of the neighboring large-width ceiling joist 4 which confronts such one of the opposite sides of such one of the reduced-width ceiling joists 3.

A portion of the ceiling, specifically a portion of at least one of the panels 7, is cut off to define an oblong mounting opening 8 into which the recessed overhead lighting device 9A of the present invention is embedded. The recessed overhead lighting device 9A of the present invention includes a generally rectangular shade structure 10 having an inner surface finished to provide a light reflective surface 11 and configured so as to encase one or a plurality of tubular lamps (two tubular lamps being shown by the phantom lines 59 in FIG. 2) such as, for example, fluorescent lamps. The shade structure 10 is so configured as to concurrently serve as a lamp casing and also as a reflector and is therefore compact as compared with the conventional recessed overhead lighting device of a double-walled structure in which a gap intervenes between the casing and the reflector.

The shade structure 10 is made up of a rectangular top wall, inclined side walls flared outwardly from opposite side edges of the top wall, opposite end walls and generally upturned side flanges 21 continued respectively from lower side edges of the inclined side walls. Two pairs of mounting members 12 of a substantially identical construction are pivotally mounted on the top wall of the shade structure 10. The details of each of the mounting members 12 will now be described with particular reference to FIGS. 2 and 3.

Figure 2:
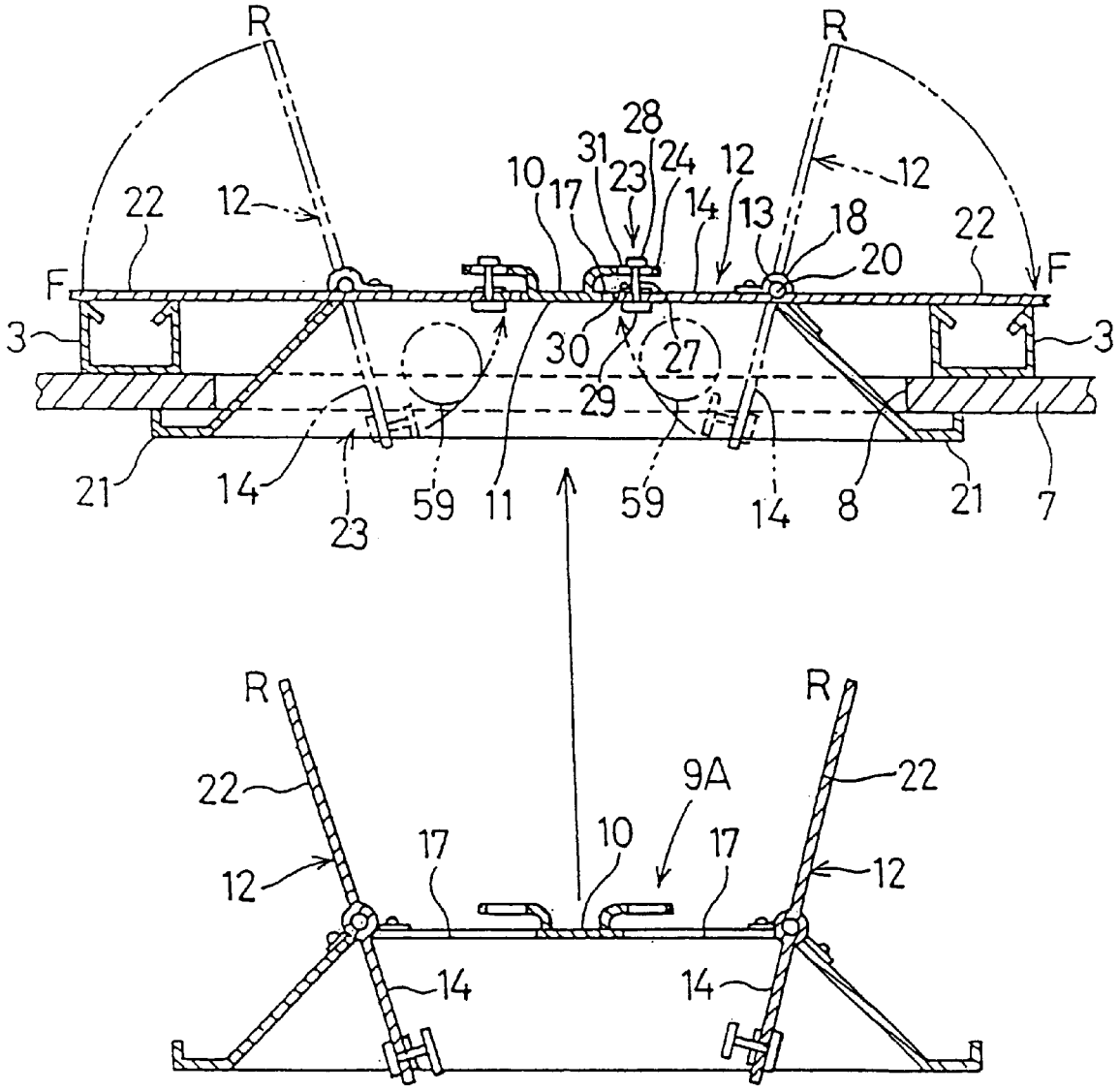
FIG. 2 is a transverse cross-section of the recessed overhead lighting device of FIG. 1 taken along a line perpendicular to the longitudinal sense of the lighting device.
Figure 3:
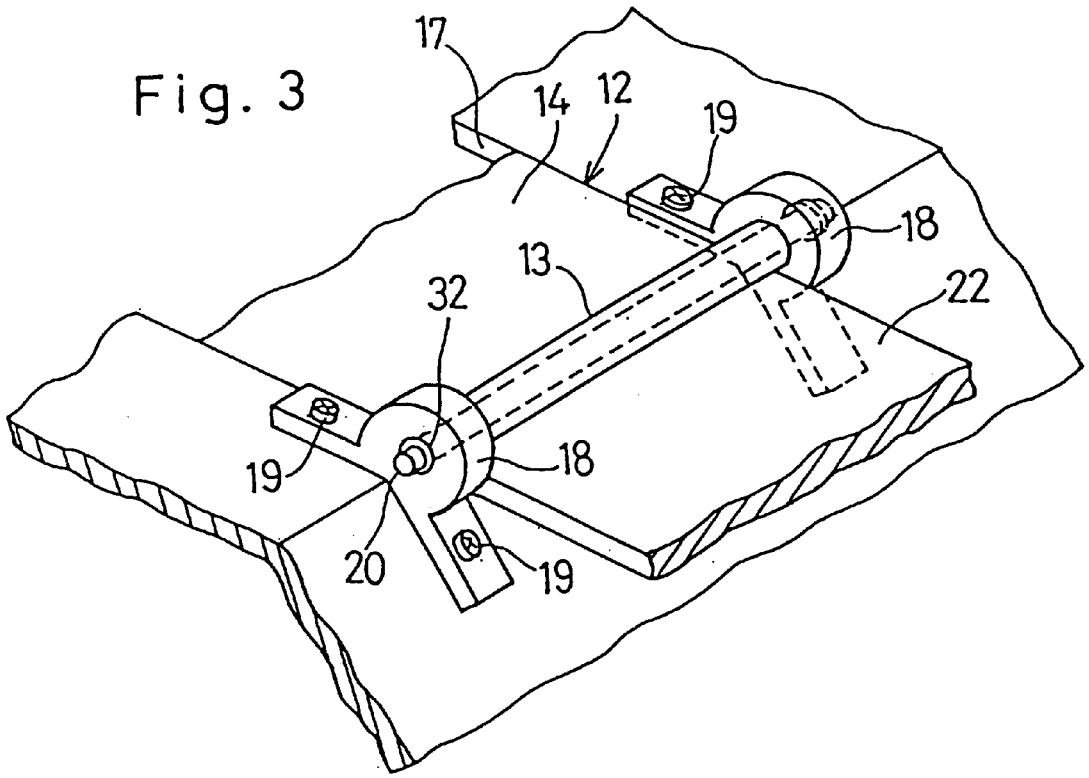
FIG. 3 is a fragmentary perspective view, on an enlarged scale, of one of mounting members employed in the recessed overhead lighting device shown in FIG. 1.

FIG. 2 illustrates a transverse cross-section of the lighting device 9A taken along a line perpendicular to the longitudinal sense X of the lighting device 9A and FIG. 3 illustrates a fragmentary perspective view of one of the mounting members 12. As shown therein, each mounting member 12 is in the form of a generally rectangular plate which may be made of a synthetic resin by the use of a plastics molding technique, for example, an extrusion or injection molding technique. As best shown in FIG. 3, each mounting member 12 has a generally intermediate portion formed integrally with a transverse bearing ridge 13 protruding outwardly from a surface of the respective mounting member 12 and extending widthwise of the respective mounting member 12, in which ridge 13 is formed a through-hole for the passage therethrough of a shaft 20 as will be described later. Each mounting member 12 has a closure body 14 and a retainer body 22 which are opposite to each other and which are defined on respective sides of the bearing ridge 13.

For each of the mounting members 12, the top wall of the shade structure 10 is formed with a rectangular opening 17 extending widthwise of the respective mounting member 12 from a joint between the top wall of the shade structure 10 and the respective inclined side wall of the shade structure 10 to a portion of the top wall of the shade structure that is spaced from the joint between the top and side walls of the shade structure 10 a distance corresponding to the length of the closure body of the respective mounting member 12. A bearing piece 18 having a pair of legs integrally formed therewith is positioned on each side of the rectangular opening 17 at the joint between the top and side walls of the shade structure 10 and is fixedly mounted on the shade structure 10 with its legs secured respectively to the top and side walls of the shade structure 10 by means of any suitable fastening members 19 such as, for example, screws.

Each mounting member 12 is pivotally mounted on the shade structure 10 with the shaft 20 extending in the through-hole of the bearing ridge 13 with the opposite ends of the shaft 20 extending outwardly through the respective bearing pieces 18 and fixed in position by mean of stop members 32 which may be split rings or split pins. Thus, each mounting member 12 is pivotable about the shaft 20 between a set position F, in which as shown by the solid line in FIG. 2, the respective mounting member 12 lies parallel to the top wall of the shade structure 10 with the closure body thereof held flush with the top wall of the shade structure 10 to thereby close the associated rectangular opening 17, and a release position R in which as shown by the phantom line in FIG. 2, the respective mounting member 12 lies generally transverse to the top wall of the shade structure 10 with the closure and retainer bodies 14 and 22 thereof positioned generally above and below the top wall of the shade structure 10, respectively.

Thus, so long as the mounting members 12 are all held in the release position R, the lighting device 9A of the present invention can be inserted from below into the mounting opening 8 in the ceiling panel 7 until the upturned side flanges 21 are brought into abutment with side lip regions of the ceiling panel 7 around the mounting opening 8. After the lighting device 9A has been inserted into the mounting opening 8, the mounting members 12 have to be pivoted from the release position R to the set position F about the corresponding shafts 20 until the retainer bodies 22 thereof are brought into contact with the neighboring ceiling joists 3 and 4.

Once each mounting member 12 has been pivoted to the set position F, it can be locked in position at the set position F by means of a releasable lock means which will now be described. The releasable lock means includes a fixture 23 secured to a free end of each mounting member 12 remote from the retainer body 22, and an engagement 24 fixedly mounted on a portion of the top wall of the shade structure 10 that is left between the pairs of the rectangular openings 17 defined in the top wall of the shade structure 10 as hereinbefore described. The fixture 23 for each mounting member 12 includes a stud shaft 27 having its opposite ends provided respectively with an engagement piece 28 and a manipulatable knob 29, a generally intermediate portion of said stud shaft 27 extending rotatably across the thickness of the closure body 14 of the respective mounting member 12.

Figure 4:
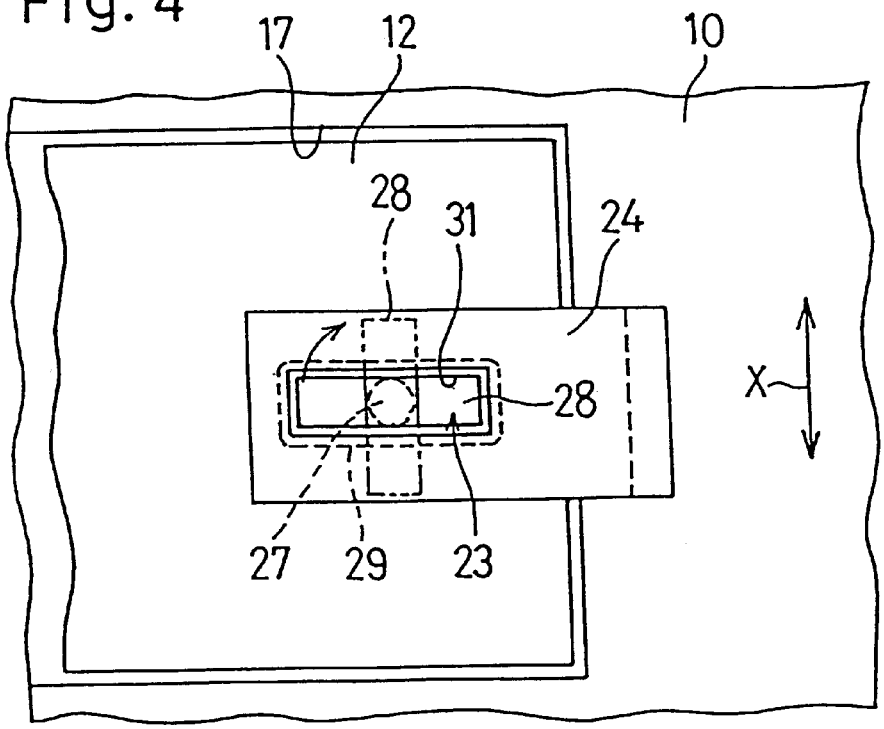
FIG. 4 is a fragmentary top plan view, on an enlarged scale, of a portion of each mounting member, showing a releasable lock means employed therefor.

On the other hand, as best shown in FIG. 4 showing a top plan view of the releasable lock means for each mounting member 12, the engagement 24 for each mounting member 12 is formed with an engagement hole 31 of a size sufficient to pass the engagement piece 28 on the respective mounting member 12 therethrough. The fixture 23 is carried by the free end of each mounting member 12 remote from the retainer body 22 with the engagement piece 28 retained at a position spaced from the closure body 14 by means of a clip member 30 (FIG. 2) such as, for example, a C-clip clipped onto the stud shaft 27, so that as the respective mounting member 12 is pivoted towards the set position F as shown by the solid line in FIG. 2, the engagement piece 28 can be automatically inserted into and pass through the engagement hole 31.

It is to be noted that the engagement piece 28 in each of the fixtures 23 fixedly carried by the respective mounting members 12 has a shape similar to, but slightly undersized relative to that of each engagement hole 31 defined in the engagement 24 mounted on the top wall of the shade structure 10.

The manner in which the recessed overhead lighting device 9A of the structure described above is mounted to the ceiling will now be described.

Prior to the lighting device 9A being mounted to the ceiling, the lighting device 9 has the mounting members 12 all pivoted to the release position R so that the retainer bodies of the respective mounting members 12 will not contact the peripheral lip region of the ceiling panel 7 around the mounting opening 8 during insertion of the shade structure 10 through the mounting opening 8. In this condition, the shade structure 10 is inserted from below into the mounting opening 8 in the ceiling panel 7 until the upturned side flanges 21 are brought into abutment with the peripheral side lip regions of the ceiling panel 7 around the mounting opening 8, to thereby complete insertion of the shade structure 10 into the mounting opening 8.

Thereafter, the closure bodies 14 of the respective mounting members 12 are to be successively pushed upwardly one at a time to cause the mounting members 12 to be pivoted from the release position R towards the set position F. As the mounting members 12 being pivoted towards the set position F approaches the set position F, the engagement pieces 28 of the respective fixtures 23 are inserted through the associated engagement holes 31 in the engagements 24. When the mounting members 12 are completely pivoted to the set position F, the retainer bodies 22 of the respective mounting members 12 are brought into contact with upper surface of the ceiling joists 3 and the closure bodies 14 of the respective mounting members 12 are received in the rectangular openings 17 in the ceiling panel 7 and, at the same time, the engagement pieces 28 of the fixtures 23 which have past the engagement holes 31 are brought to a position above the associated engagements 24.

While the shade structure 10 has been kept inserted in the mounting opening 8 in the manner described above, the attendant worker has to turn the manipulatable knobs 29 of the respective fixtures 23 a predetermined angle of, for example, 90° in either direction about the stud shafts 27. Considering that in the illustrated embodiment each engagement piece 28 is of a rectangular shape and the associated engagement hole 31 is similar in shape to, but slightly over-sized relative to the shape of the engagement piece 28 as hereinbefore described, turn of the manipulatable knob 29 integral or fast with the stud shaft 27 results in the engagement piece 28 having been oriented perpendicular to the longitudinal sense of the engagement hole 31 as shown by the dotted line in FIG. 4. By so doing, the mounting members 12 are all locked in the set position F, thereby completing the mounting of the shade structure 10 in the mounting opening 8. Thereafter, the tubular lamps 59 are fitted to the lighting device 9 in a manner well known to those skilled in the art.

As hereinabove described, the lighting device 9A is fitted to the ceiling substantially in a fashion with the ceiling panel 7 sandwiched between the upturned side flanges 21 of the shade structure 10 and the retainer bodies 22 of the respective mounting members 12. Accordingly, the present invention advantageously eliminates the use of insert screws which have hitherto been required to be embedded in the concrete ceiling slab in readiness for the support of the conventional lighting device from the concrete ceiling slab.

Also, firm securement of the lighting device 9A to the ceiling can be accomplished from below merely by pivoting the mounting members 12 from the release position R to the set position F about the respective shafts 20 and then by turning the manipulatable knobs 29, the lighting device 9A of the present invention can easily and quickly fitted to the ceiling with no sophisticated skill required. Moreover, since the lighting device 9A of the present invention can be connected directly to the ceiling joists 3 and 4 and the ceiling panel 7, it can be stably supported without being displaced in position relative to the ceiling panel, skewed, damaged and/or separated even though an earthquake occurs.

Considering that so long as the lighting device 9A is secured in position to the ceiling with the mounting members 12 pivoted to the set position F, the closure bodies 14 of the respective mounting members 12 have at least a downwardly oriented surface held flush with a correspondingly downwardly oriented surface of the top wall of the shade structure 10 and, therefore, the aesthetic appearance of the lighting device 9A will not be deteriorated.

The lighting device 9A of the structure according to the present invention is, as shown in FIG. 1, disposed with its longitudinal sense X lying parallel to any one of die ceiling joists 3 and 4 and includes a plurality of pairs of the mounting members 12 (though the illustrated lighting device 9A employs two pairs of the mounting members 12 positioned respectively adjacent the opposite end portions of the top wall of the shade structure 10) mounted on the shade structure 10 so as to extend parallel to any one of the ceiling joist supports 1. Accordingly, depending on the position of the mounting opening 8 defined in the ceiling panel 7, it may occur that the retainer bodies 22 of at least one pair of the mounting members 12 then held at the release position R may collide against the ceiling joist support 1 during the insertion of the shade structure 10 into the mounting opening 8.

To avoid this possibility, the pairs of the mounting members 12 are spaced in a direction parallel to the longitudinal sense X thereof an asymmetrical distance with respect to a line passing through a point C intermediate of the length of the lighting device 9A in a direction transverse to the longitudinal sense X of the lighting device 9A. By way of example, in the illustrated embodiment, as shown in FIG. 1, one of the two pairs of the mounting members 12 are disposed at a location spaced endwise a distance A from the intermediate point C whereas the other of the two pairs of the mounting members 12 are disposed at a location spaced endwise a greater distance A+α from the intermediate point C in a direction opposite to such one of the two pairs of the mounting members 12. This design is particularly advantageous in that, in the event that one of the pairs of the mounting members 12 then held in the release position R are likely to collide against the ceiling joist support 1 at the time of insertion of the shade structure 10 into the mounting opening 8, the lighting device 9A has to be reversed endwise to allow the other of the pairs of the mounting members 12 in the release position R to move clear from such ceiling joist support 1 during the insertion of the shade structure 10 into the mounting opening 8.

Figure 5:
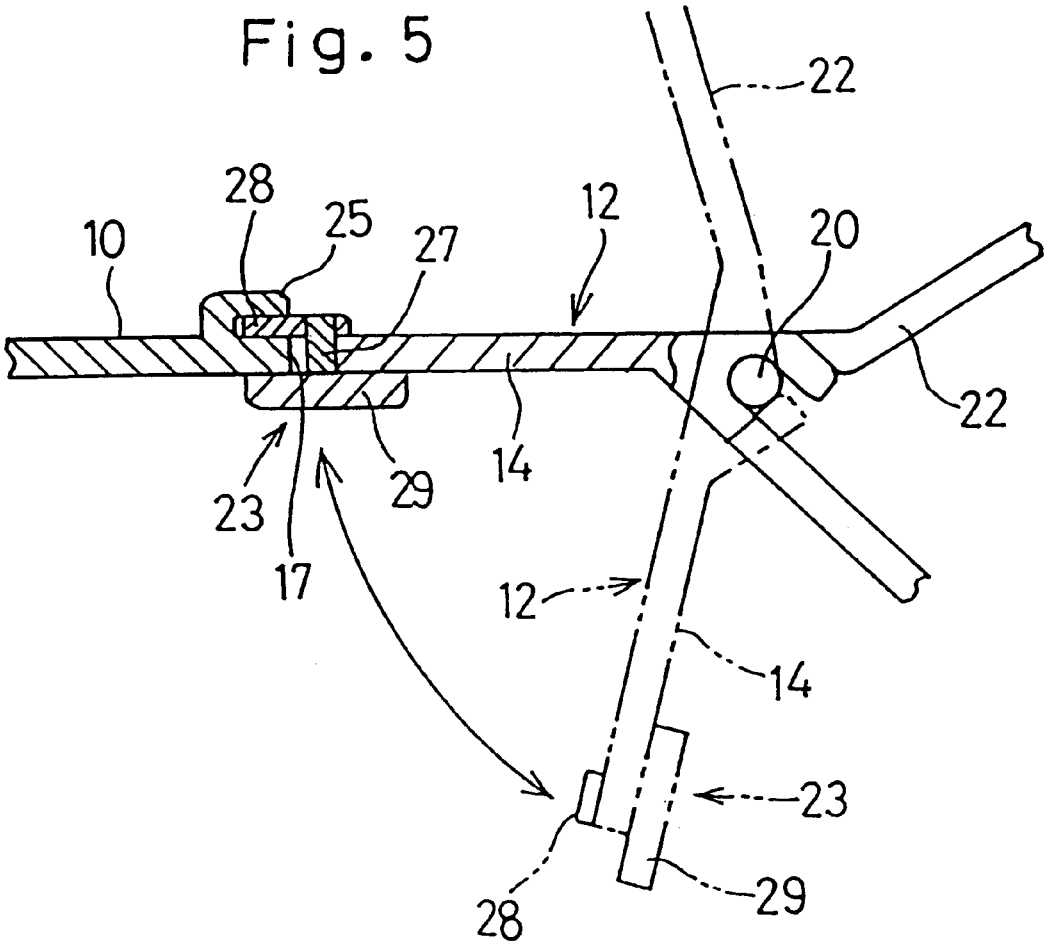
FIG. 5 is a fragmentary transverse sectional view, showing a modified form of the releasable lock means.

FIG. 5 illustrates a modified releasable lock means for locking the fixture 23 on each mounting member 12 to the shade structure 10. In this modification shown in FIG. 5, in place of the engagement 24 for each of the mounting members 12, the shade structure 10 is integrally formed with a catch 25 by the use of an aluminum extrusion molding technique. On the other hand, the engagement piece 28 of the fixture 23 on each of the mounting members 12 has a length sufficient to allow the engagement piece 28 to protrude outwardly from the free end of the closure body 14 of the respective mounting member 12 when the manipulatable knob 29 is turned. The manipulatable knob 29 employed in this modification is of a diameter sufficient to allow a peripheral portion of the manipulatable knob 29 to similarly protrude laterally outwardly from the free end of the closure body 14 of the respective mounting member 12. The engagement piece 28 and the manipulatable knob 29 are connected together through the stud shaft 27 extending across the closure body 14 of the respective mounting member 12.

According to the modification shown in FIG. 5, after each of the mounting members 12 is pivoted to the set position F while the engagement piece 28 is held in position with its free end not protruding laterally outwardly from the closure body 14 thereof as shown by the double-dotted line in FIG. 5, to thereby allow the closure body 14 to be received in the rectangular opening 17, the manipulatable knob 29 has to be turned about the stud shaft 27 to allow the free end of the engagement piece 28 to protrude laterally outwardly from the closure body 14 and then to be received in between the shade structure 10 and the catch 25, to thereby completely lock the respective fixture 23 relative to the shade structure 10. Since according to this modification the engagement piece 28 and the manipulatable knob 29 sandwich the shade structure 10, a rather firm locking is possible.

Figure 6:
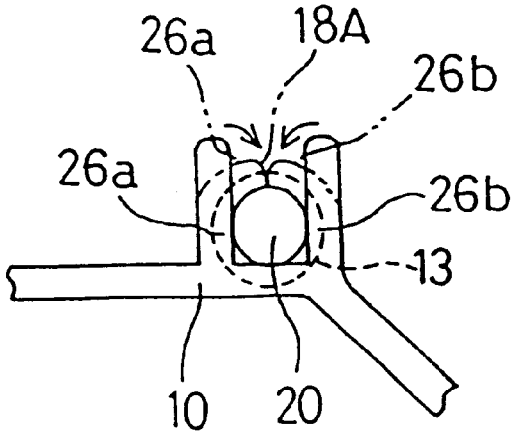
FIG. 6 is a fragmentary transverse view showing a modified form of each shaft bearing for the support of the respective mounting member.

Each of the mounting members 12 may alternatively be supported for pivotal movement between the release position R and the set position F in a manner as shown in FIG. 6. In place of the use of the bearing piece 18 for each end of the shaft 20 carried by each mounting member 12, the shade structure 10 may be formed integrally with a pair of hinge defining pieces 26*a* and 26*b* spaced from each other a distance corresponding to the diameter of the shaft 20. According to the modification shown in FIG. 6, after the respective mounting member 12 having the associated shaft 20 having been inserted in the through-hole in the bearing ridge 13 has been mounted on the shade structure 10 with opposite ends of the shaft 20 received in between the hinge defining pieces 26*a* and 26*b*, respective free end portions of the hinge defining pieces 26*a* and 26*b* have to be crimped inwardly to embrace the opposite ends of the shaft 20 to thereby complete respective shaft bearings 18A shown by the dotted line in FIG. 6. The shaft bearings 18A shown in FIG. 6 are indeed easy to form and does not require the use of bearing members separate from the shade structure 10.

(Second Preferred Embodiment)

Figure 7:
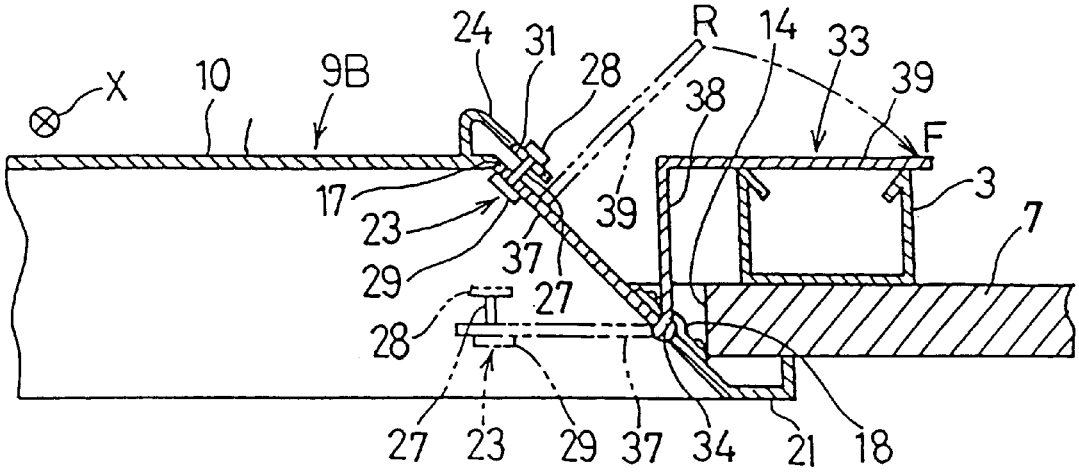
FIG. 7 illustrates a fragmentary transverse cross-sectional view, taken along a line perpendicular to the longitudinal sense of the lighting device, showing a portion of the lighting device according to a second preferred embodiment of the present invention.

FIG. 7 illustrates a fragmentary transverse cross-section, taken along a line perpendicular to the longitudinal direction X of the lighting device, showing a second preferred embodiment of the present invention. This embodiment shown in FIG. 7 differs from the first embodiment shown in FIGS. 1 to 4 lies in the shape of each mounting member and the position at which each mounting member is mounted pivotally on the shade structure 10.

More specifically, each mounting member now identified by 33 is of one-piece construction including a generally rectangular closure body 37, a generally elongated retainer body 39, and a connecting body 38 connecting the closure body 37 and the retainer body 39 together and extending perpendicular to the retainer body 39, but angled relative to the closure body 37. The mounting member 33 is also integrally formed with stud shafts 34 each protruding laterally outwardly from a joint between the closure body 37 and the connecting body 38 so as to extend in a direction parallel to the longitudinal sense X of the shade structure 10 and to be pivotally mounted on the shade structure 10 with the stud shafts 34 received by the respective shaft bearings 18.

The closure body 37 defined on one side of the stud shafts 34 opposite to the connecting body 38 of the mounting member 33 is adapted to close the rectangular opening 17, which is in the illustrated second embodiment defined in each inclined side wall of the shade structure 10, when the mounting member 33 is pivoted to the set position F as shown by the solid line in FIG. 7. On the other hand, an end portion of the mounting member 33 on the other side of the stud shafts 34 opposite to the closure body 37 defines the connecting body 38 and the retainer body 39 which when the mounting member 33 is pivoted to the set position F, extend perpendicular to and parallel to the top wall of the shade structure 10, respectively.

According to the second embodiment shown in FIG. 7, not only can a free end of the retainer body 39 of the mounting member 33 then held at the release position R shown by the phantom line in FIG. 7 be positioned at a level lower than that in the first embodiment shown in and described with reference to FIGS. 1 to 4, but the angle through which the mounting member 33 is pivoted between the release position R and the set position F about the stud shafts 34 is also smaller than that in the first embodiment. Accordingly, the lighting device 9B according to the second embodiment of the present invention can advantageously be fitted to the ceiling in which the grid-patterned panel support framework including the ceiling joists 3 and 4 is spaced a smaller distance below from the concrete ceiling slab.

(Third Preferred Embodiment)

Figure 8:
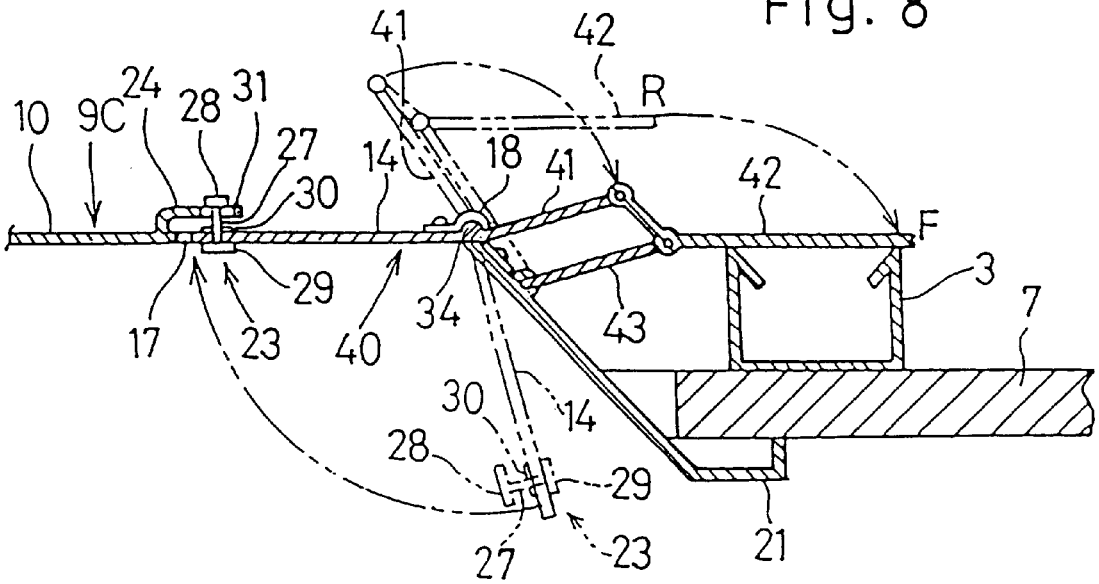
FIG. 8 is a fragmentary transverse cross-sectional representation, a portion of the lighting device according to a third preferred embodiment of the present invention.

Referring to FIG. 8, there is shown in a fragmentary transverse crosssectional representation, a portion of the lighting device 9C according to a third preferred embodiment of the present invention. The lighting device 9C according to this embodiment of FIG. 8 differs from that according to the previously described first embodiment so far as only the shape of each mounting member is concerned, although the mounting member in the third embodiment is fitted to the shade structure 10 at the same location as that in the first embodiment.

More specifically, the mounting member now identified by 40 has stud shafts 34 protruding laterally outwardly therefrom as is the case with those in the second embodiment and is pivotally mounted on the shade structure 10 with the stud shafts 34 received by the respective shaft bearings 18. This mounting member 40 includes, in addition to the closure body 14, an extension 41 integral therewith and positioned on one side of the stud shafts 34 opposite to the closure body 14, said extension 41 having a free end to which a retainer body 42 of a generally angled configuration is rotatably connected. A connecting rod 43 is rotatably connected at one end with a portion of the corresponding inclined side wall of the shade structure 10 and at the opposite end with a bent portion of the angled retainer body 42.

According to the third embodiment shown in FIG. 8, the retainer body 42 is foldable as shown by the phantom line in FIG. 8 as the mounting member 40 is pivoted about the stud shafts 34 from the set position F towards the release position R. Accordingly, not only can a free end of the retainer body 42 of the mounting member 40 then held at the release position R shown by the phantom line in FIG. 8 be positioned at a level lower than that in the second embodiment shown in and described with reference to FIG. 7, but also the radius of curvature of an angular path along which each of the extension 41 and the retainer body 42 pivots is smaller than the angle through which the mounting member 33 employed in the second embodiment is pivoted between the release position R and the set position F about the stud shafts 34. Therefore, the lighting device 9C according to the third embodiment of the present invention can advantageously be fitted to the ceiling in which the grid-patterned panel support framework including the ceiling joists 3 and 4 is spaced a smaller distance below from the concrete ceiling slab.

(Fourth Preferred Embodiment)

The lighting device 9D according to a fourth preferred embodiment of the present invention is similar to that according to the first embodiment of the present invention except that a portion of each mounting member is modified. The lighting device 9D according to the fourth embodiment of the present invention is shown in FIGS. 9 and 10 in a transverse cross-sectional representation with the modified mounting member being partly shown in FIG. 11 in a fragmentary perspective representation.

Figure 9:
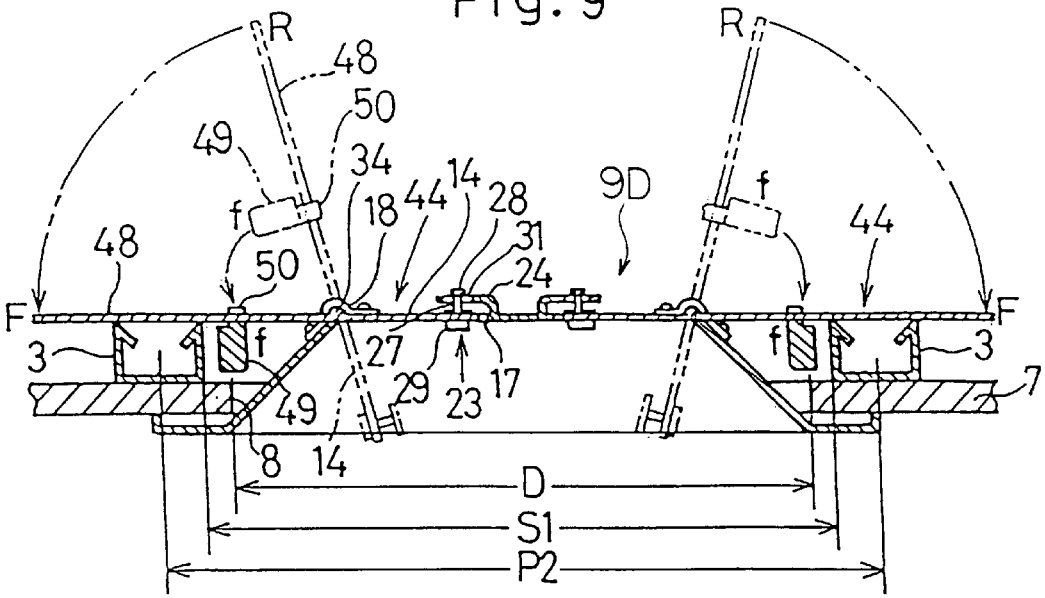
FIGS. 9 and 10 are transverse cross-sectional representations of the lighting device according to a fourth preferred embodiment of the present invention, showing two different modes of installation of the lighting device, respectively.
Figure 10:
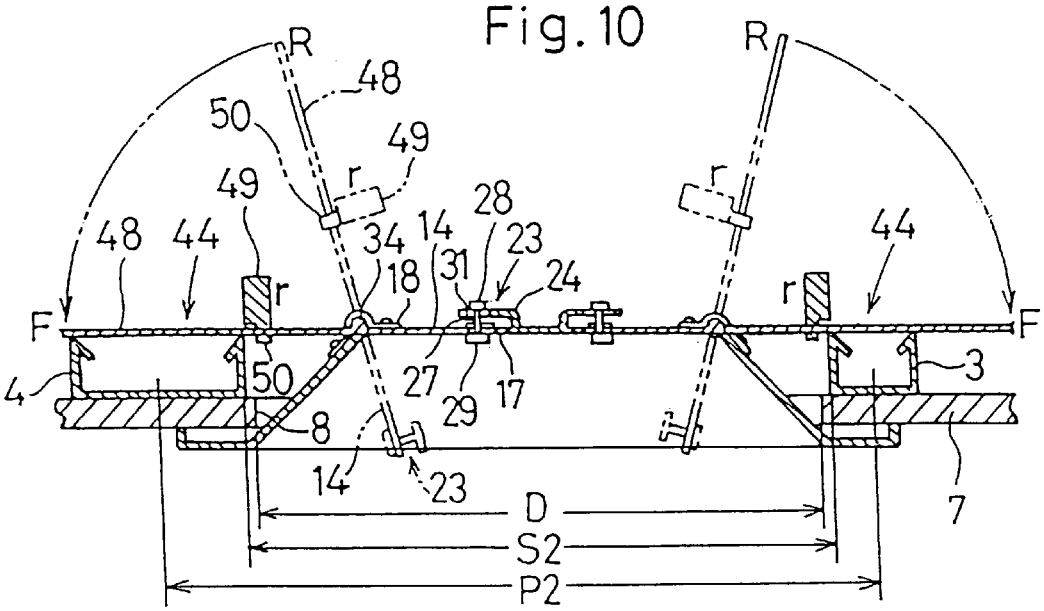
Figure 11:
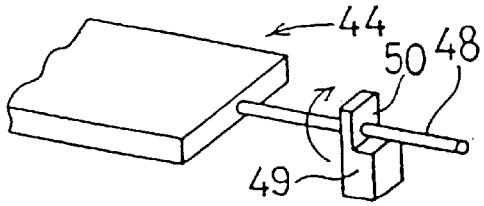
FIG. 11 is a fragmentary perspective view, on an enlarged scale, of a portion of each mounting member employed in the lighting device shown in FIGS. 9 and 10.

Referring now to FIGS. 9 to 11, each mounting member now identified by 44 includes, in addition to the closure body 14 similar in shape to that of the mounting member 12 employed in the first embodiment of the present invention, a retainer body 48 in the form of a rod extending outwardly from the closure body 14. The mounting member 44 has stud shafts 34 formed integrally therewith so as to protrude laterally outwardly in alignment with each other and is pivotally mounted on the shade structure 10 with the stud shafts 34 received by the respective shaft bearings 18.

As best shown in Fig. 11, a spacer 49 is rotatably mounted on the rod-like retainer body or retainer rod 48 of each mounting member 44 by means of a respective bearing piece 50. This spacer 49 is rotatable 180° about the associated retainer rod 48 between an advanced position f, at which the spacer 49 is positioned so as to assume a side-by-side relation with the adjacent ceiling joist 3 or 4 as shown in FIG. 9, and a retracted position r at which the spacer 49 is positioned so as to assume a position offset from the adjacent ceiling joist 3 or 4 about the retainer rod 48 as shown in FIG. 10. Although not shown, as a means for locking the spacer 49 on each retainer rod 48 at one of the advanced and retracted positions f and r, any known locking means may be employed which comprises an elastic projection provided in one of the associated bearing piece 50 and the retainer rod 48 and a detent recess provided in the other of the associated bearing piece 50 and the retainer rod 48 so that the elastic projection can be detachably engaged in the detent recess to hold the spacer 49 assuredly at one of the advanced and retracted positions f and r.

As described previously, although the ceiling joists 3 and 4 are disposed spaced the predetermined pitch P2 from each other as shown in FIG. 1, the spacing between the neighboring ceiling joists may differ depending on whether the neighboring ceiling joists employed on respective sides of the shade structure 10 are those identified by 3 or whether they are those identified respectively by 3 and 4, because of the presence of the varying widths W1 and W2 of the ceiling joists 3 and 4. Specifically, the spacing S1 between the neighboring ceiling joists 3 shown in FIG. 9 would be greater than the spacing S2 between the neighboring ceiling joists 3 and 4 shown in FIG. 10. On the other hand, it is a general practice to form the mounting opening 8 in the ceiling panel 7 in reference to the respective positions of the ceiling joists 3 and 4 and the resultant mounting opening 8 would have a fixed width independent on whether the neighboring ceiling joists 3 are employed on respective sides of the shade structure 10 or whether the ceiling joists 3 and 4 are employed on respective sides of the shade structure 10.

However, the lighting device 9D according to the fourth embodiment of the present invention is so designed and so configured as to accommodate the difference between the spacings S1 and S2 because of the spacers 49 on the retainer rods 48 are adjustable in position relative to the associated retainer rods 48 as can readily understood from the comparison between FIGS. 9 and 10.

By way of example, where only the reduced-width ceiling joists 3 are found positioned on respective sides of the mounting opening 8 in the ceiling panel 7 as shown in FIG. 9, the spacing S1 between the reduced-width ceiling joists 3 is relatively large and the mounting opening 8 so defined in the ceiling panel 7 has a fixed width D. In such case, the spacers 49 on the respective retainer rods 48 have to be moved to and locked at the advanced position f so that when the mounting members 44 are pivoted to the set position F shown by the solid line in FIG. 9 after the shade structure 10 with the mounting members 44 held in the release position R have been inserted into the mounting opening 8, the spacers 49 can be positioned inwardly adjacent the respective ceiling joists 3, to thereby compensate for an otherwise large gap between the shade structure 10 and the respective ceiling joists 3, e.g., to thereby prevent the lighting device 9D from being displaced sidewise under the influence of vibrations taking place in the ceiling.

On the other hand, FIG. 10 illustrates the condition in which because of the use of the ceiling joists 3 and 4 of different widths on respective sides of the mounting opening 8, the spacing S2 between the ceiling joists 3 and 4 are relatively small, i.e., smaller than the spacing S1 shown in FIG. 9, and the mounting opening 8 so defined in the ceiling panel 7 has a fixed width D. In such case, the spacers 49 on the respective retainer rods 48 have to be moved to and locked at the retracted position r so that when the mounting members 44 are pivoted one at a time to the set position F as shown by the solid line in FIG. 10, the spacers 49 will not collide against the ceiling joists 3 and 4.

(Fifth Preferred Embodiment)

Figure 12:
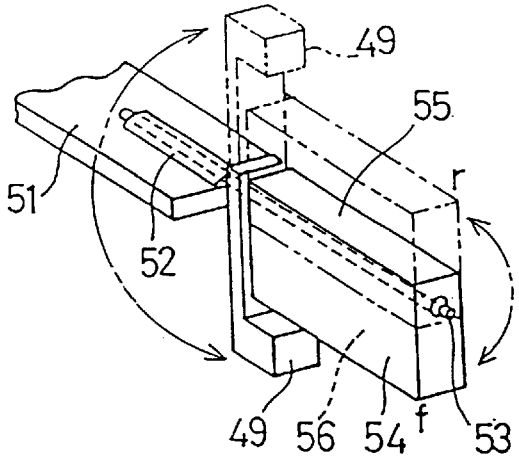
FIG. 12 illustrates a fragmentary perspective view of a portion of each mounting member employed in the lighting device according to a fifth preferred embodiment of the present invention.
Figure 13A:
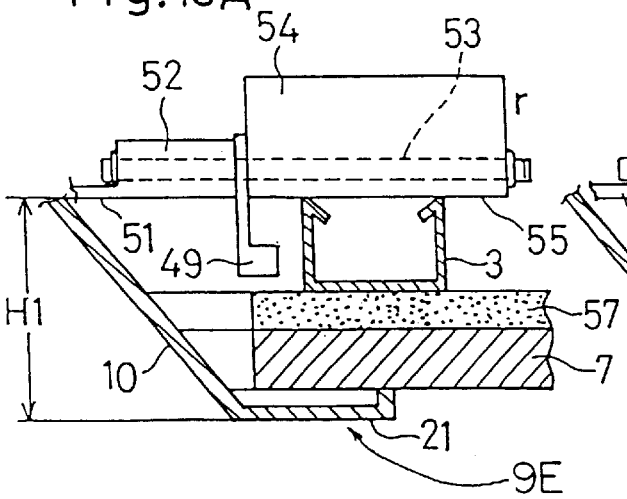
FIGS. 13A and 13B are longitudinal sectional representations of that portion of the mounting member shown in FIG. 12 with different thickness of the ceiling panel, respectively.
Figure 13B:
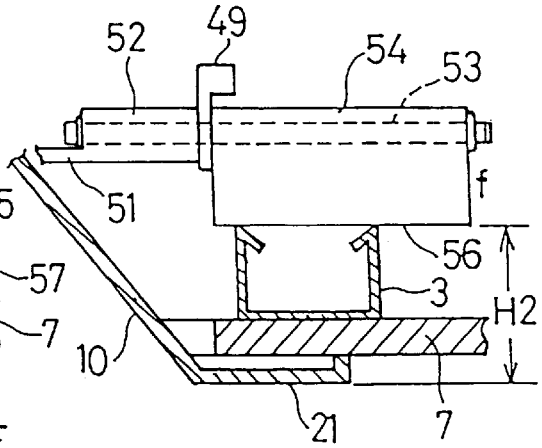

FIG. 12 illustrates a fragmentary perspective view of a portion of each mounting member employed in the lighting device according to the fifth preferred embodiment of the present invention and FIGS. 13A and 13B are longitudinal sectional representations of that portion of the mounting member shown in FIG. 12. According to this fifth preferred embodiment, the lighting device 9E can accommodate not only a varying spacing S1 or S2 as is the case with that according to the previously described fourth embodiment of the present invention, but also a varying thickness of the ceiling panel 7. More specifically, a free end of each mounting member in the form of a generally rectangular plate now identified by 51 adjacent the ceiling joist 3 is formed with a rod bearing 52 extending lengthwise thereof and a retainer rod 53 is inserted into the rod bearing 52. A spacer 49 similar to that employed in the previously described fourth embodiment and a generally rectangular block-like attachment 54 are rotatably mounted on the retainer rod 53.

It is to be noted that the block-like attachment 54 has first and second side abutment faces 55 and 56 opposite to each other and that the retainer rod 53 extends axially through the block-like attachment 54 at a location laterally offset from the longitudinal axis of the attachment 54 towards the first side abutment face 55 for the reason which will become clear from the subsequent description. Briefly speaking, the attachments 54 angularly adjustably mounted on the respective retainer rods 53 rigid with the closure bodies 14 of the mounting members 51 serve to accommodate a change in thickness of the ceiling to thereby adjust the heightwise level at which the shade structure 10 is installed relative to the ceiling joists 3 and 4.

Where as shown in FIG. 13A the ceiling is comprised of the ceiling panel 7 and a liner board 57 such as, for example, a plaster board placed or bonded to an upper surface of the ceiling panel 7 and has therefore an increased thickness, the attachment 54 has to be turned about the retainer rod 53 to bring the first side abutment face 55 thereof in position to contact the ceiling joist 3 or 4 so that the respective ceiling joist 3 or 4 and the ceiling of the increased thickness can be sandwiched between the upturned side flange 21 of the shade structure 10 and the first side abutment face 55.

In other words, with the attachment 54 turned around the retainer rod 53 to orient the first side abutment face 55 downwardly as shown in FIG. 13A, a relatively large height H1 can be secured between the level flush with an lower surface of the upturned side flange 21 integral with the shade structure 10 and the level flush with the first side abutment face 55 of the attachment 54, which height H1 is sufficient to accommodate the thickness of the ceiling joist 3 or 4 plus the increased thickness of the ceiling. Thus, in the condition in which the attachment 54 is positioned with the first side abutment face 55 oriented downwardly, the spacing between the upturned side flange 21 of the shade structure 10 and the first side abutment face 55 can be adjusted to accommodate the thickness of the ceiling joist 3 or 4 plus the increased thickness of the ceiling.

On the other hand, where as shown in FIG. 13B the ceiling is comprised solely of the ceiling panel 7, the attachment 54 has to be turned about the retainer rod 53 to bring the second side abutment face 56 thereof in position to contact the ceiling joist 3 or 4 to thereby reduce the height H1 down to a height H2 corresponding to the thickness of the ceiling joist 3 or 4 plus the thickness of the ceiling panel 7. Thus, in the condition in which the attachment 54 is positioned with the second side abutment face 56 oriented downwardly as shown in FIG. 13B, the spacing between the upturned side flange 21 of the shade structure 10 and the second side abutment face 56 can be adjusted to accommodate the thickness of the ceiling joist 3 or 4 plus the thickness of the ceiling panel 7.

According to the fifth embodiment of the present invention, merely by adjusting the position of the attachments 54 about the respective retainer rods 53, the lighting device 9E can advantageously accommodate the varying thickness of the ceiling.

(Sixth Preferred Embodiment)

Figure 14:
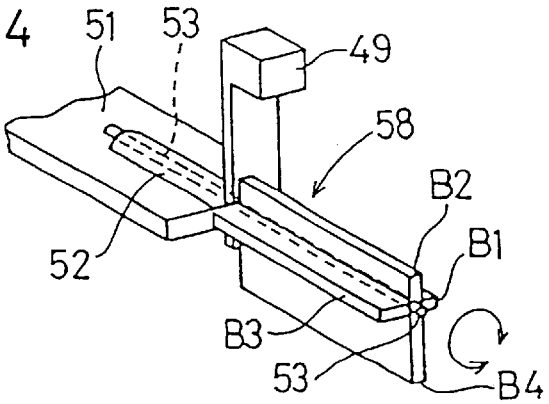
FIG. 14 illustrates a fragmentary perspective view of a similar portion of each mounting member employed in the lighting device according to a sixth preferred embodiment of the present invention.

FIG. 14 illustrates a fragmentary perspective view of that portion of each mounting member employed in the lighting device according to the sixth preferred embodiment of the present invention. In the practice of this sixth embodiment of the present invention, in place of the block-like attachment 54 employed in the preceding embodiment of the present invention, an attachment 58 of a generally cross-shaped section having first to fourth side abutment faces B1 to B4 spaced 90° from each other about the retainer rod 53 and also spaced a progressively varying distance laterally outwardly from the retainer rod 53 is employed. More specifically, the use of the cross-shaped attachment 58 is advantageous in that by selecting one of the first to fourth side abutment faces B1 to B4 so as to be oriented downwardly, the lighting device embodying the present invention can accommodate four varying thicknesses of the ceiling.

(Seventh Preferred Embodiment)

Figure 15:
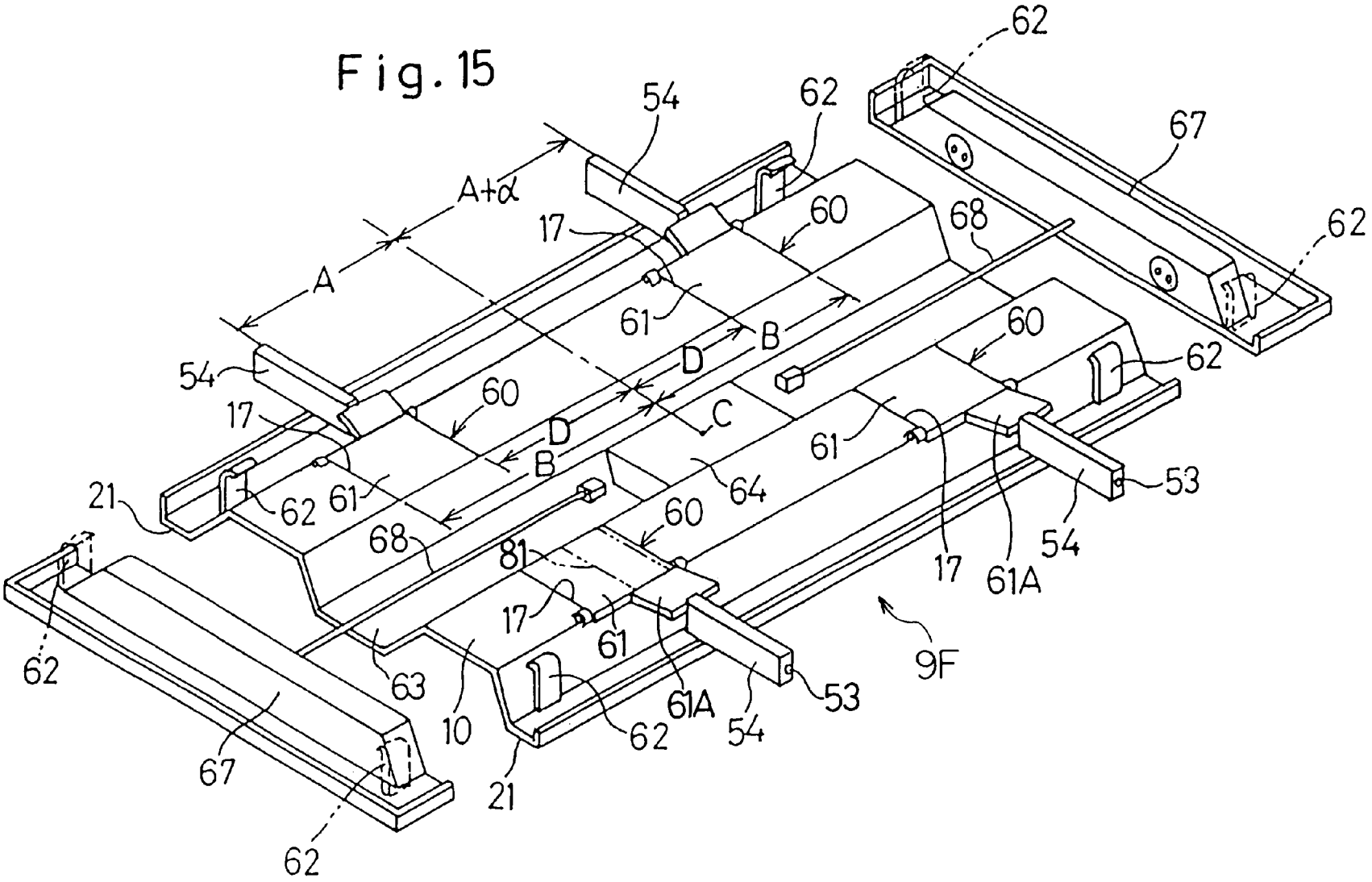
FIG. 15 is an exploded view of the lighting device according to a seventh preferred embodiment of the present invention as viewed from top.

The recessed overhead lighting device 9F according to the seventh embodiment of the present invention is shown in an exploded view in FIG. 15. Each mounting member, now identified by 60 and employed in the lighting device according to the seventh embodiment of the present invention, is provided with the attachment 54 similar to that shown in FIG. 12 for accommodating a change in thickness of the ceiling to thereby adjust the heightwise level at which the shade structure 10 is installed relative to the ceiling joists 3 and 4. The closure body 61 of each mounting member 60 is in the form of a generally rectangular plate, but has a relatively large width as compared with that of the mounting member employed in any one of the foregoing embodiments of the present invention.

Specifically, while in any one of the foregoing embodiments of the present invention the closure body of each mounting member has been shown and described as employed in the form of a generally elongated plate shown by the phantom line 81 and having a width corresponding to the associated retainer body and/or the associated attachment 54, the closure body 61 of each mounting member 60 employed in the seventh embodiment of the present invention is in the form of a generally rectangular plate having a width increases a quantity corresponding to the distance a shown in FIG. 1. An end extension 61 A formed integrally with the closure body 61 so as to extend in a direction axially of the closure body 61 in each mounting member 60 has a width smaller than that of the associated closure body 61 and is bent to extend upwardly relative to the closure body 61 with a retainer rod 53 axially connected to a free end of the end extension 61A.

In the event that at the time of installation of the shade structure 10 the attachments 54 carried by the mounting members 60 of FIG. 15 then held at the release position or the retainer elements 22, 39, 42, 48 employed in any one of the foregoing embodiments shown respectively in FIGS. 7 to 14 are likely to collide against the ceiling joist support 1 as discussed in connection with the first embodiment of the present invention with reference to FIG. 1, the pairs of the mounting members 60 are spaced in a direction parallel to the longitudinal sense thereof an asymmetrical distance with respect to a line passing through a point C intermediate of the length of the lighting device 9F in a direction transverse to the longitudinal sense of the lighting device 9F. In the case of the seventh embodiment in which the number of the pairs of the mounting members 60 employed is two, one of the two pairs of the mounting members 60 are disposed at a location spaced endwise a distance A from the intermediate point C whereas the other of the two pairs of the mounting members 60 are disposed at a location spaced endwise a greater distance A+α from the intermediate point C in a direction opposite to such one of the two pairs of the mounting members 12, so that when the lighting device 9F is reversed endwise prior to insertion of the shade structure 10 into the mounting opening 8, the other of the pairs of the mounting members 60 in the release position R can move clear from such ceiling joist support 1 during the insertion of the shade structure 10 into the mounting opening 8.

The asymmetrical disposition of the pairs of the mounting members 60 with respect to the line passing through the intermediate point C of the lighting device 9F may pose a problem, i.e., reduction in aesthetic appearance, when the lighting device 9F is viewed from below.

To eliminate the problem, the closure bodies 61 of the two respective mounting members 60 which are disposed asymmetrical in a longitudinal direction of the shade structure 10 with respect to the intermediate point C are formed in a substantially rectangular shape when viewed from above so that as shown in FIG. 15, respective inner side edges of the longitudinally spaced mounting members 60 on each side of the shade structure 10, which confront with each other, are spaced an equal distance D in opposite directions from the imaginary line passing through the intermediate point C in a direction transverse to the longitudinal sense of the shade structure 10 and, at the same time, respective outer side edges of the longitudinally spaced mounting members 60, opposite to the associated inner side edges referred to above, are spaced an equal distance B in opposite directions from such imaginary line passing through the intermediate point C. This disposition of the mounting members 60 is advantageous in that not only can any possible collision of the attachments 54 against the ceiling joist support 1 be avoided when the shade structure 10 is reversed endwise prior to insertion into the mounting opening 8, but any possible reduction in aesthetic appearance can also be avoided.

Furthermore, in the seventh embodiment of the present invention shown in FIG. 15, two pairs of insertion guide pieces 62, one pair on each side of the shade structure 10, are formed at respective joints between the upturned side flanges 21 and the adjacent inclined side walls of the shade structure 10 so as to protrude upwardly. The insertion guide pieces 62 of each pair are spaced a distance slightly smaller than the width of the mounting opening 8 in the ceiling panel 7 so that during the insertion of the shade structure 10 into the mounting opening 8, the shade structure 10 can be smoothly inserted into the mounting opening 8 with the pairs of the insertion guide pieces 62 guided along opposite cut edges defining the mounting opening 8. The use of the pairs of the insertion guide pieces 62 does not only bring about an increase in workability, but also avoid a possible damage to the ceiling which would occur when during the insertion of the shade structure 10 into the mounting opening 8 the shade structure 10 is unnecessarily be shaken laterally.

It is to be noted that the position of the pairs of the insertion guide pieces 62 may not be always limited to that shown in FIG. 15 and, alternatively, they may be connected to, or otherwise formed integrally with, opposite end members 67 of the shade structure 10, respectively, as shown by the phantom lines in FIG. 15. In addition, in the illustrated embodiment shown in FIG. 15, an electric lighting circuit unit 64 including an inverter is accommodated fixedly within a recess 63 with an electric socket cable 68 extending within the recess 63 to connect the lighting circuit unit 64 with lamp sockets which are carried by the respective end members 67 of the shade structure 10.

(Eighth Preferred Embodiment)

Figure 16A:
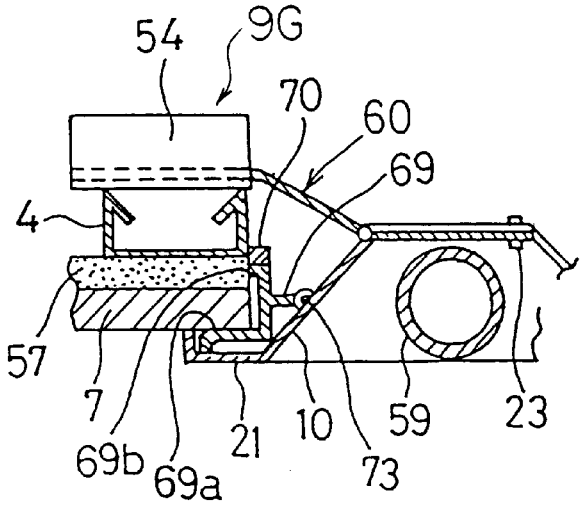
FIGS. 16A and 16B are fragmentary transverse cross-sectional views of a portion of the lighting device according to an eighth preferred embodiment of the present invention, showing an attachment held in different operative positions, respectively.
Figure 16B:
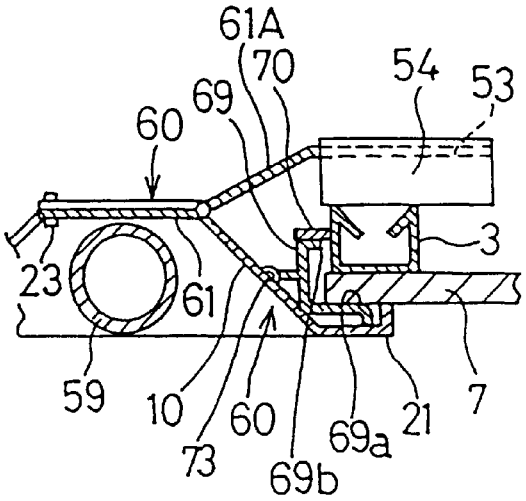

The lighting device 9G according to the eighth embodiment of the present invention is shown in FIGS. 16A and 16B which illustrates a fragmentary transverse cross-section of a portion of the lighting device 9G. In the lighting device according to the eighth embodiment of the present invention, at least two pairs of left and right centering members 69 are secured pivotally through respective pivot pins 73 to the opposite inclined side walls of the shade structure 10 adjacent the corresponding upturned side flanges 21. Only one of the left centering members 69 of one pair is shown in FIG. 16A whereas one of the right centering members 69 of one pair is shown in FIG. 16B.

The pairs of the left and right centering members 69 serves to align the shade structure 10 with the mounting opening 8 during the insertion of the shade structure 10 into the mounting opening 8 in a centered fashion. For this purpose, each centering member 69 is of a generally L-shaped configuration including an engagement arm 69*a*, which is, prior to the adjacent upturned side flange 21 is brought into contact with the ceiling panel 7 during the insertion of the shade structure 10 into the mounting opening 8, engaged from below with the ceiling panel 7, and a side contact arm 69*b* lying generally perpendicular to the engagement arm 69*a* and adapted to be brought into contact with the side face of the adjacent ceiling joist 3 or 4. An abutment piece 70 is fitted to a free end of the side contact arm 69*b* remote from the engagement arm 69*a*. The abutment piece 70 is made of, for example, a spring or a synthetic resin having an elasticity, that is, extensibility or flexibility.

It is to be noted that each mounting member 60 employed in the eighth embodiment of the present invention is identical with that shown in and described with reference to FIG. 15 and, therefore, the respective retainer rod 53 having the attachment 54 rotatably mounted thereon is fitted to the inclined end extension 61A. The centering member 69 discussed above is positioned immediately below the associated end extension 60A of each mounting member 60.

The lighting device 9G according to the eighth embodiment of the present invention can be mounted to the ceiling panel 7 in the following manner. When the shade structure 10 with the mounting members 60 held in the release position R is inserted from below into the mounting opening 8 in the ceiling panel 7, the paired centering members 69 are also inserted into the mounting opening 8 together with the shade structure 10 and the engagement arms 69*a* of the respective paired centering members 69 are subsequently brought into contact with the lower surface of the ceiling panel 7. As the shade structure 10 is further inserted into the mounting opening 8, the engagement arms 69*a* of the respective paired centering members 69 are pushed downwardly in contact with the ceiling panel 7 with the centering members 69 consequently pivoted about the pivot pins 73. At the time the upturned side flanges 21 of the shade structure 10 are brought into contact with the ceiling panel 7, the side contact arms 69*b* of the respective centering members 69 then pivoting about the pivot pins 73 are brought into contact with the adjacent side faces of the neighboring ceiling joists 3 and 4 and, at the same time, the associated abutment pieces 70 are elastically deformed in contact with the adjacent side faces of the neighboring ceiling joists 3 and 4, wherefor the shade structure 10 can be automatically centered relative to the mounting opening 8 by the action of not only the opposite side contact arms 69*b* of the pairs of the centering members 69, but also the associated abutment pieces 70.

According to the eighth embodiment of the present invention, the shade structure 10 can easily and quickly positioned at a centered position in and relative to the mounting opening 8.

It is to be noted that FIG. 16A illustrates the condition in which the mounting opening 8 defined in the ceiling panel 7 is positioned within the relatively narrow spacing S2 (See FIG. 1) delimited between the reduced-width ceiling joist 3 and the large-width ceiling joist 4 whereas FIG. 16B illustrates the condition in which the mounting opening 8 defined in the ceiling panel 7 is positioned within the relatively large spacing S1 (Also see FIG. 1) delimited between the reduced-width ceiling joists 3. Where the lighting device is to be installed within the relatively narrow spacing S2 as shown in FIG. 16A, the abutment pieces 70 on each side of the shade structure 10 are compressed a quantity corresponding to half the difference (=(S1−S2)/2) between the spacings S1 and S2 so that the shade structure 10 mounted in the mounting opening 8 can be centered relative to the mounting opening 8.

(Ninth Preferred Embodiment)

Figure 17A:
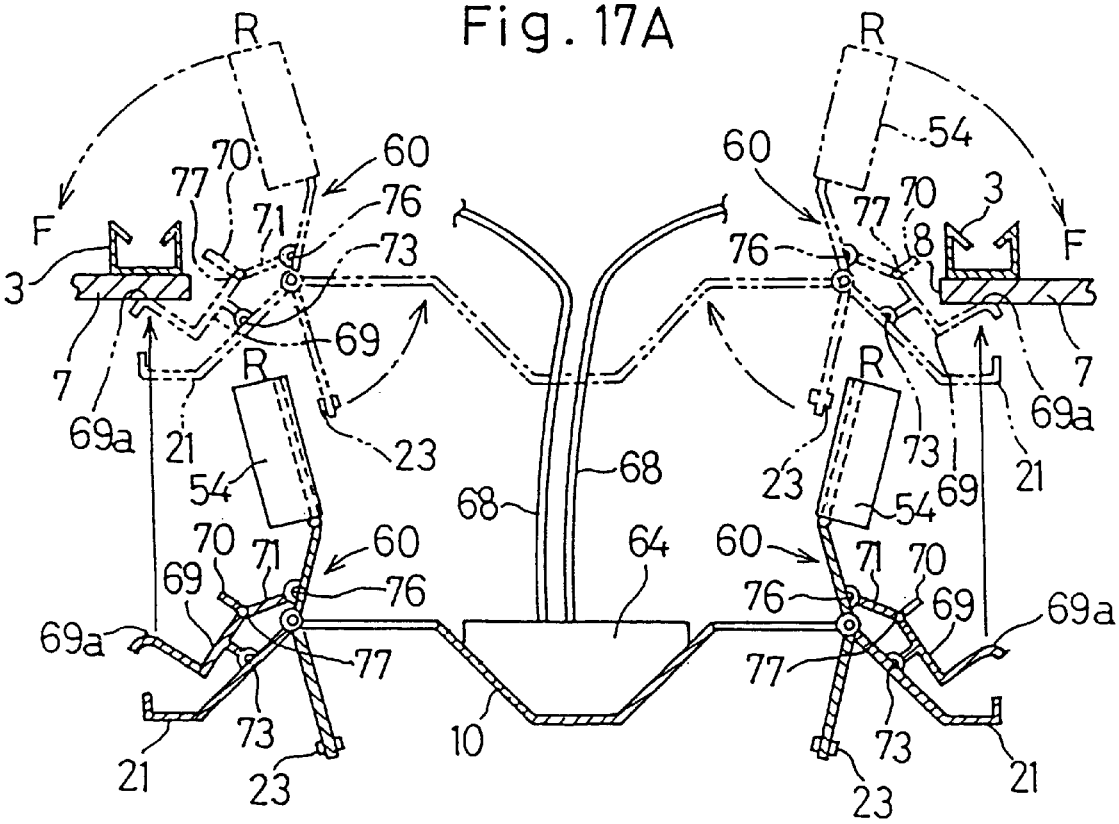
FIGS. 17A and 17B are transverse cross-sectional views of the lighting device according to a ninth preferred embodiment of the present invention, showing the shade structure ready to be inserted into the mounting opening and completely inserted into the mounting opening, respectively.
Figure 17B:
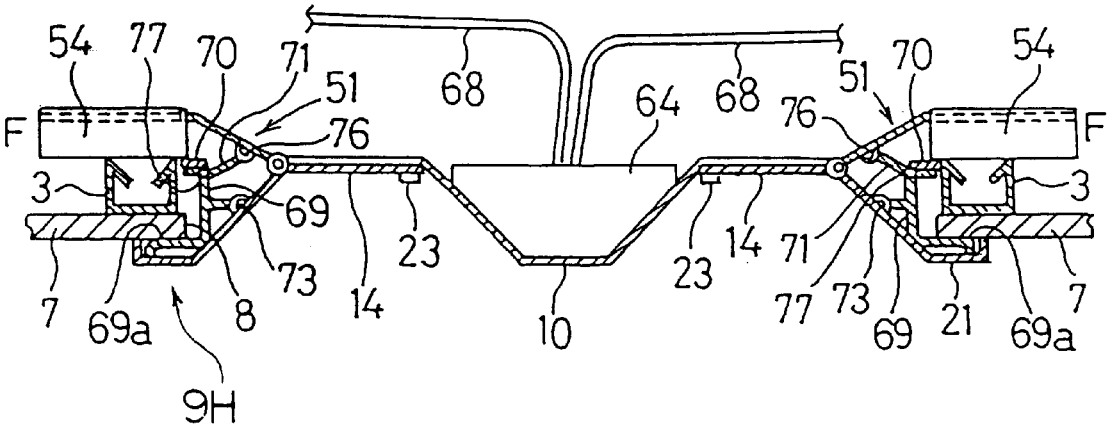

FIGS. 17A and 17B illustrates the lighting device 9H according to a ninth embodiment of the present invention in a transverse cross-sectional view. In this ninth embodiment of the present invention, each centering member 69 similar to that employed in the previously described eighth embodiment is pivotally secured through the pivot pin 73 to the corresponding side wall of the shade structure 10 in a manner similar to that shown in and described with reference to FIGS. 16A and 16B. In addition, a connecting lever 71 having one end pivotally connected through a connecting pin 76 with each mounting member 60 has its opposite end pivotally connected with the associated centering member 69 through a connecting pin 77 so that the centering member 69 can be operatively associated with the corresponding mounting member 60 through the respective connecting lever 71.

The manner in which the lighting device according to the ninth embodiment of the present invention is installed to the ceiling will now be described. At the time of insertion of the shade structure 10 from below into the mounting opening 8, the mounting members 60 have to be held in the release position R as shown by the solid line in FIG. 17A. As the shade structure 10 is inserted from below into the mounting opening 8, respective upper portions of the centering members 69 are also inserted into the mounting opening 8 with the engagement arms 69*a* consequently brought into contact with the lower surface of the ceiling panel 7 as shown by the double-dotted lines in FIG. 17A. As the shade structure 10 is farther inserted into the mounting opening 8, the engagement arms 69*a* of the respective centering members 69 are pushed downwardly in contact with the ceiling panel 7 with the centering members 69 consequently pivoted about the pivot pins 73. This pivotal movement of the centering members 69 is transmitted to the associated mounting members 60 through the corresponding connecting levers 71 and, therefore, the mounting members 60 are angularly moved towards the set position F in response to pivot of the centering members 69 as shown by the double-dotted arrows.

At the time the upturned side flanges 21 of the shade structure 10 are brought into contact with the ceiling panel 7 with the shade structure 10 completely inserted in the mounting opening 8 as shown in FIG. 17B, the side contact arms 69*b* of the respective centering members 69 then pivoting about the pivot pins 73 are brought into contact with the adjacent side faces of the neighboring ceiling joists 3 to cause the shade structure 10 to be automatically centered with respect to the mounting opening 8. At the same time, the mounting members 60 then pivoting towards the set position F in response to the pivot of the associated centering members 69 are automatically set in the set position F with the corresponding attachments 54 resting on upper edges of the ceiling joists 3.

Thus, according to the ninth embodiment of the present invention, mere insertion of the shade structure 10 into the mounting opening 8 is sufficient not only to allow the shade structure 10 to be automatically centered relative to the mounting opening 8, but also to cause the mounting members 60 to be automatically moved to the set position F in which the ceiling panel 7 and the ceiling joists 3 are sandwiched between the attachments 54 and the upturned side flanges 21. Thereafter, the fixtures 23 have to be manipulated to firmly secure the lighting device to the ceiling.

Even according to the ninth embodiment of the present invention, the shade structure 10 can easily and quickly positioned at a centered position in and relative to the mounting opening 8.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A recessed overhead lighting device adapted to be encased in a mounting opening defined in a ceiling panel which is supported by ceiling joists, said lighting device comprising:

a shade structure for supporting at least one tubular lamp and having a reflective surface for reflecting light from the tubular lamp, said shade structure having a longitudinal axis and also having opposite side flanges;

at least one pair of generally elongated mounting members mounted on the shade structure, each of said elongated mounting members having first and second end portions opposite to each other, said mounting members of the pair being disposed on respective sides of the shade structure with respect to the longitudinal axis thereof and pivotally movable between release and set positions, said mounting members being held in the release position to allow insertion of the shade structure from below into the mounting opening, said mounting members being pivoted towards the set position above the ceiling joists, when the shade structure is inserted from below into the mounting opening, to cause the first end portions of the mounting members to cooperate with the side flanges of the shade structure below the ceiling panel to sandwich the ceiling joists and the ceiling panel;

a fixture provided on each of the mounting members for locking the associated mounting member at the set position after the shade structure has been completely inserted into the mounting opening; and at least one pair of centering members pivotally mounted on the shade structure and spaced in a direction widthwise of the shade structure, each of said centering members including an engagement arm, which is, during insertion of the shade structure from below into the mounting opening, pushed in contact with the ceiling panel to cause the corresponding centering member to pivot, and a side abutment arm which is held in contact with a side face of the adjacent ceiling joist in response to the pivot of the corresponding centering member.

2. The recessed overhead lighting device as claimed in claim 1, wherein said second end portion of each of the mounting members is a closure body, said closure body having a lower surface which is held in flush with a lower surface of the shade structure when the associated mounting member is pivoted to the set position.

3. The recessed overhead lighting device as claimed in claim 1, wherein each of the mounting member is pivotally mounted on the shade structure by means of a shaft member extending parallel to the longitudinal axis of the shade structure.

4. The recessed overhead lighting device as claimed in claim 1, further comprising a spacer mounted on each of the mounting members and movable between an advanced position, at which the spacer confronts a side portion of the shade structure facing the adjacent ceiling joist, and a retracted position at which the spacer is retracted upwardly of the adjacent ceiling joist.

5. The recessed overhead lighting device as claimed in claim 1, further comprising an attachment angularly adjustably mounted on each of the mounting members, said attachment having a plurality of side abutment faces spaced angularly from each other about a longitudinal axis of the corresponding mounting member, said side abutment faces being spaced a progressively varying distance laterally outwardly from the longitudinal axis of the corresponding mounting member, said attachment forming said first end portion of each of the mounting members.

6. The recessed overhead lighting device as claimed in claim 1, wherein the shade structure is disposed with its longitudinal axis lying parallel to the ceiling joist and wherein two pairs of the mounting members are employed with the mounting members of each pair positioned on one side of the shade structure with respect to the longitudinal axis thereof, said pairs of the mounting members being spaced an asymmetric distance endwise from an imaginary line drawn so as to extend transverse to a point intermediate of the length of the shade structure.

7. The recessed overhead lighting device as claimed in claim 1, further comprising at least one pair of insertion guide pieces fixedly mounted on respective sides of the shade structure with respect to the longitudinal axis thereof, said insertion guide pieces of the pair being spaced a distance slightly smaller than a width of the mounting opening in a direction widthwise of the shade structure.

8. The recessed overhead lighting device as claimed in claim 1, wherein each of the centering members is connected with a connecting member for angularly moving the respective centering member in operative association with angular movement of the corresponding mounting member, each of said centering members being pivoted in response to contact of the engagement arm with the ceiling panel during insertion of the shade structure into the mounting opening, but prior to the side flanges brought into contact with the ceiling panel, to thereby cause the respective mounting member to be pivoted from the release position towards the set position.

9. The recessed overhead lighting device as claim 1, further comprising an elastic abutment piece provided on the side abutment arm of each of the centering members, said elastic abutment piece being elastically deformed in contact with a side face of the adjacent ceiling joist.

10. A recessed overhead lighting device adapted to be encased in a mounting opening defined in a ceiling panel which is supported by ceiling joists, said lighting device comprising:

a shade structure for supporting at least one tubular lamp and having a reflective surface for reflecting light from the tubular lamp, said shade structure having a longitudinal axis and also having opposite side flanges;

at least one pair of generally elongated mounting members mounted on the shade structure, each of said elongated mounting members having first and second end portions opposite to each other, said mounting members of the pair being disposed on respective sides of the shade structure with respect to the longitudinal axis thereof and movable between release and set positions, said mounting members being held in the release position during insertion of the shade structure from below into the mounting opening, said mounting members being pivoted towards the set position, when the shade structure is inserted from below into the mounting opening, to cause the first end portions of the mounting members to cooperate with the side flanges of the shade structure to sandwich the ceiling joists and the ceiling panel;

a fixture provided on each of the mounting members for locking the associated mounting member at the set position after the shade structure has been completely inserted into the mounting opening, and a spacer mounted on each of the mounting members and movable between an advanced position, at which the spacer confronts a side portion of the shade structure facing the adjacent ceiling joist, and a retracted position at which the spacer is retracted upwardly of the adjacent ceiling joist.

11. A recessed overhead lighting device adapted to be encased in a mounting opening defined in a ceiling panel which is supported by ceiling joists, said lighting device comprising:

a shade structure for supporting at least one tubular lamp and having a reflective surface for reflecting light from the tubular lamp, said shade structure having a longitudinal axis and also having opposite side flanges;

at least one pair of generally elongated mounting members mounted on the shade structure, each of said elongated mounting members having first and second end portions opposite to each other, said mounting members of the pair being disposed on respective sides of the shade structure with respect to the longitudinal axis thereof and movable between release and set positions, said mounting members being held in the release position during insertion of the shade structure from below into the mounting opening, said mounting members being pivoted towards the set position, when the shade structure is inserted from below into the mounting opening, to cause the first end portions of the mounting members to cooperate with the side flanges of the shade structure to sandwich the ceiling joists and the ceiling panel;

a fixture provided on each of the mounting members for locking the associated mounting member at the set position after the shade structure has been completely inserted into the mounting opening; and an attachment angularly adjustably mounted on each of the mounting members, said attachment having a plurality of side abutment faces spaced angularly from each other about a longitudinal axis of the corresponding mounting member, said side abutment faces being spaced a progressively varying distance laterally outwardly from the longitudinal axis of the corresponding mounting member, said attachment forming said first end portion of each of the mounting members.

12. A recessed overhead lighting device adapted to be encased in a mounting opening defined in a ceiling panel which is supported by ceiling joists, said lighting device comprising:

a shade structure for supporting at least one tubular lamp and having a reflective surface for reflecting light from the tubular lamp, said shade structure having a longitudinal axis and also having opposite side flanges;

at least one pair of generally elongated mounting members mounted on the shade structure, each of said elongated mounting members having first and second end portions opposite to each other, said mounting members of the pair being disposed on respective sides of the shade structure with respect to the longitudinal axis thereof and movable between release and set positions, said mounting members being held in the release position during insertion of the shade structure from below into the mounting opening, said mounting members being pivoted towards the set position, when the shade structure is inserted from below into the mounting opening, to cause the first end portions of the mounting members to cooperate with the side flanges of the shade structure to sandwich the ceiling joists and the ceiling panel; and a fixture provided on each of the mounting members for locking the associated mounting member at the set position after the shade structure has been completely inserted into the mounting opening, wherein the shade structure is disposed with its longitudinal axis lying parallel to the ceiling joist and wherein two pairs of the mounting members are employed with the mounting members of each pair positioned on one side of the shade structure with respect to the longitudinal axis thereof, said pairs of the mounting members being spaced on asymmetric distance endwise from an imaginary line drawn so as to extend transverse to a point intermediate of the length of the shade structure.

13. A recessed overhead lighting device adapted to be encased in a mounting opening defined in a ceiling panel which is supported by ceiling joists, said lighting device comprising:

a shade structure for supporting at least one tubular lamp and having a reflective surface for reflecting light from the tubular lamp, said shade structure having a longitudinal axis and also having opposite side flanges;

at least one pair of generally elongated mounting members mounted on the shade structure, each of said elongated mounting members having first and second end portions opposite to each other, said mounting members of the pair being disposed on respective sides of the shade structure with respect to the longitudinal axis thereof and movable between release and set positions, said mounting members being held in the release position during insertion of the shade structure from below into the mounting opening, said mounting members being pivoted towards the set position, when the shade structure is inserted from below into the mounting opening, to cause the first end portions of the mounting members to cooperate with the side flanges of the shade structure to sandwich the ceiling joists and the ceiling panel;

a fixture provided on each of the mounting members for locking the associated mounting member at the set position after the shade structure has been completely inserted into the mounting opening; and at least one pair of centering members pivotally mounted on the shade structure and spaced in a direction widthwise of the shade structure, each of said centering members including an engagement arm, which is, during insertion of the shade structure from below into the mounting opening, pushed downwardly in contact with the ceiling panel to cause the corresponding centering member to pivot, and a side abutment arm which is held in contact with a side face of the adjacent ceiling joist in response to the pivot of the corresponding centering member, wherein each of the centering members is connected with a connecting member for angularly moving the respective centering member in operative association with angular movement of the corresponding mounting member, each of said centering members being pivoted in response to contact of the engagement arm with the ceiling panel during insertion of the shade structure into the mounting opening, but prior to the side flanges brought into contact with the ceiling panel, to thereby cause the respective mounting member to be pivoted from the release position towards the set position.

* * * * *